US010161292B1

(12) United States Patent
Park et al.

(10) Patent No.: US 10,161,292 B1
(45) Date of Patent: Dec. 25, 2018

(54) COOLING SYSTEM FOR A VEHICLE AND A CONTROL METHOD THEREFOR

(71) Applicants: HYUNDAI MOTOR COMPANY, Seoul (KR); KIA MOTORS CORPORATION, Seoul (KR)

(72) Inventors: Cheol Soo Park, Suwon-si (KR); Dong Suk Chae, Seoul (KR); Phil Gi Lee, Suwon-si (KR); Jun Sik Park, Seoul (KR); Jea Woong Yi, Uiwang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/825,233

(22) Filed: Nov. 29, 2017

(30) Foreign Application Priority Data

Oct. 25, 2017 (KR) ..... 10-2017-0139024

(51) Int. Cl.

| | |
|---|---|
| ***F01P 7/14*** | (2006.01) |
| ***F01P 3/02*** | (2006.01) |
| ***F01P 11/08*** | (2006.01) |
| ***F02M 26/28*** | (2016.01) |

(52) U.S. Cl.
CPC ..... *F01P 7/14* (2013.01); *F01P 3/02* (2013.01); *F01P 11/08* (2013.01); *F02M 26/28* (2016.02); *F01P 2003/021* (2013.01); *F01P 2007/146* (2013.01); *F01P 2025/32* (2013.01)

(58) Field of Classification Search
CPC ..... F01P 7/14; F01P 3/02; F01P 11/08; F01P 2007/146; F01P 2025/32; F01P 2003/021; F02M 26/28
See application file for complete search history.

(56) References Cited

U.S. PATENT DOCUMENTS

| | | | | |
|---|---|---|---|---|
| 6,568,356 | B1 * | 5/2003 | Hayakawa | F01P 7/167 123/41.1 |
| 7,320,434 | B2 | 1/2008 | Suda et al. | |
| 9,470,138 | B2 * | 10/2016 | Miyagawa | F01P 7/16 |
| 9,726,068 | B2 * | 8/2017 | Murai | F01P 3/02 |
| 2005/0006487 | A1 | 1/2005 | Suda et al. | |
| 2017/0074153 | A1 * | 3/2017 | Kaneko | F01P 7/165 |
| 2017/0321595 | A1 * | 11/2017 | Jang | F01P 7/16 |
| 2018/0038267 | A1 * | 2/2018 | Murai | F01P 7/16 |
| 2018/0080366 | A1 * | 3/2018 | Toyama | B60H 1/08 |

FOREIGN PATENT DOCUMENTS

JP 2004137981 5/2004

* cited by examiner

*Primary Examiner* — Grant Moubry
(74) *Attorney, Agent, or Firm* — Lempia Summerfield Katz LLC

(57) ABSTRACT

A cooling system for a vehicle and a control method thereof improves fuel efficiency through quick warm-up of an engine by controlling a flow rate of cooling water passing through an EGR cooler. In the cooling system and control method cooling water with an increased temperature through flow stagnation control is first supplied to an oil heat exchanger side. Heat energy generated from the engine is used to rapidly raise a cooling water temperature and an oil temperature. A warm-up characteristic is improved through the exhaust heat recovery function by heat exchange between exhaust gas and the cooling water in the EGR cooler.

9 Claims, 6 Drawing Sheets

COOLING SYSTEM FOR A VEHICLE AND A CONTROL METHOD THEREFOR

CROSS REFERENCE TO RELATED APPLICATION

The present application claims priority to and the benefit of Korean Patent Application No. 10-2017-0139024, filed Oct. 25, 2017, the entire contents of which are incorporated herein for all purposes by this reference.

BACKGROUND

Technical Field

The present disclosure relates to a cooling system for a vehicle and a control method therefor, in which fuel efficiency is improved through quick warm-up of an engine by controlling a flow rate of cooling water passing through an EGR cooler.

Description of Related Art

For a cooling system using a mechanical wax-type thermostat, the temperature of the cooling water or fluid is measured using only one water or fluid temperature sensor at the outlet side of the engine, thereby determining and controlling the starting temperature of the EGR cooler.

To achieve this, the engine-outlet cooling water temperature should be the same as the cooling water temperature actually flowing into an EGR cooler. Thus, the EGR cooler is located close to the engine outlet.

However, such an arrangement of the EGR cooler may cause the controllability of other valves used for controlling cooling water to deteriorate because the EGR cooler is restricted to a certain position.

The foregoing is intended merely to aid in the understanding of the background of the present disclosure, and is not intended to mean that the present disclosure falls within the purview of the related art that is already known to those having ordinary skill in the art.

SUMMARY

Accordingly, the present disclosure is made keeping in mind the above problems occurring in the related art. The present disclosure is intended to propose a cooling system for a vehicle and a control method therefor, in which fuel efficiency is improved through quick warm-up of an engine. Quick warm-up is achieved by controlling a flow rate of cooling water passing through an EGR cooler using water temperature sensors disposed at an inlet and outlet of the engine and a flow rate control valve.

In order to achieve the above object, according to an embodiment of the present disclosure, a cooling system for a vehicle is provided. The cooling system includes: a block port communicating with a cooling water outlet of a cylinder block of an engine; a radiator port communicating with a radiator; an oil heat exchanger port communicating with an oil heat exchanger and an EGR cooler; and a flow rate control valve provided with a heater core port communicating with a heater core. In a predetermined first section starting from a first end toward a second end of an entire rotational operation section of the flow rate control valve, the block port, the radiator port, the oil heat exchanger port, and the heater core port are closed. In a predetermined second section starting from the first section toward the second end of the entire rotational operation section, the oil heat exchanger port is opened. In a predetermined third section starting from the second section toward the second end of the entire rotational operation section, the heater core port is opened with the oil heat exchanger port maximally opened.

At a boundary between the first section and the second section, an opening rate of the oil heat exchanger port may exceed 0% such that the oil heat exchanger port starts to be opened. At a boundary between the second section and the third section, the opening rate of the oil heat exchanger port may be 100% such that the oil heat exchanger port is fully opened.

At a boundary between the second section and the third section, an opening rate of the heater core port may exceed 0% such that the heater core port starts to be opened.

The opening rate of the oil heat exchanger port in the second section and the opening rate of the heater core port in the third section may increase linearly in accordance with the rotational operation of the flow rate control valve.

In order to achieve the above object, according to an embodiment of the present disclosure, a control method for a cooling system for a vehicle is provided. The cooling system includes a block port communicating with a cooling water outlet of a cylinder block of an engine, a radiator port communicating with a radiator, an oil heat exchanger port communicating with an oil heat exchanger and an EGR cooler, and a flow rate control valve provided with a heater core port communicating with a heater core. An inlet water temperature sensor and an outlet water temperature sensor are respectively disposed at an inlet side and an outlet side of the engine. The flow rate control valve is disposed at a rear end of the outlet water temperature sensor. The control method includes, when an outside temperature exceeds a preset temperature on start of the vehicle, stopping a flow of cooling water by closing ports of the flow rate control valve while a controller controls EGR to be operated. The control method also includes, when an outlet cooling water temperature measured by the outlet water temperature sensor exceeds a preset temperature for releasing the stopping the flow, determining a cooling water temperature passed through the EGR cooler by the controller in relation to the outlet cooling water temperature and EGR cooler inlet/outlet temperature difference map data of a cooling water flow rate flowing through the EGR cooler. The control method also includes opening the oil heat exchanger port at which the EGR cooler is disposed to prevent the cooling water temperature passed through the EGR cooler from exceeding a boiling cooling water temperature set to prevent overheating of the EGR cooler.

In the stopping of the flow, a moisture value may be determined.

In an initial section of the opening the oil heat exchanger port, to finely control the cooling water flow rate supplied to the EGR cooler, the flow rate control valve may be controlled such that the oil heat exchanger port is opened at a minimum opening rate for a predetermined time.

After the initial section of the opening the oil heat exchanger port, the opening rate of the oil heat exchanger port may be determined according to the outlet cooling water temperature to control the flow rate control valve.

The step of opening the oil heat exchanger port may include, when an inlet cooling water temperature measured after the initial section by the inlet water temperature sensor is equal to or lower than a predetermined temperature, and higher than the outlet cooling water temperature measured by the outlet water temperature sensor, determining an opening rate compensation value of the oil heat exchanger port. The opening rate compensation value is based on a function of a difference value between the inlet cooling water temperature and the outlet cooling water temperature. The step of opening the oil heat exchanger port may also include compensatingly controlling the oil heat exchanger port to be opened by compensatingly feeding the opening rate compensation value of the outlet cooling water temperature back to the opening rate of the oil heat exchanger port.

According to the present disclosure, since the cooling water with the increased temperature through the flow stagnation control is first supplied to the oil heat exchanger side, the heat energy generated from the engine is used to rapidly raise the cooling water temperature and the oil temperature. The warm-up characteristic is improved through the exhaust heat recovery function by heat exchange between the exhaust gas and the cooling water in the EGR cooler, whereby it is possible to improve fuel efficiency by reducing engine friction and heat loss.

BRIEF DESCRIPTION OF THE DRAWINGS

The above and other objects, features and other advantages of the present disclosure will be more clearly understood from the following detailed description when taken in conjunction with the accompanying drawings, in which:

FIG. 6 is a diagram showing an opening rate of the flow rate control valve according to the embodiment of the present disclosure.

DETAILED DESCRIPTION OF THE DISCLOSURE

Hereinbelow, an embodiment of the present disclosure is described in detail with reference to the accompanying drawings.

Figure 1:
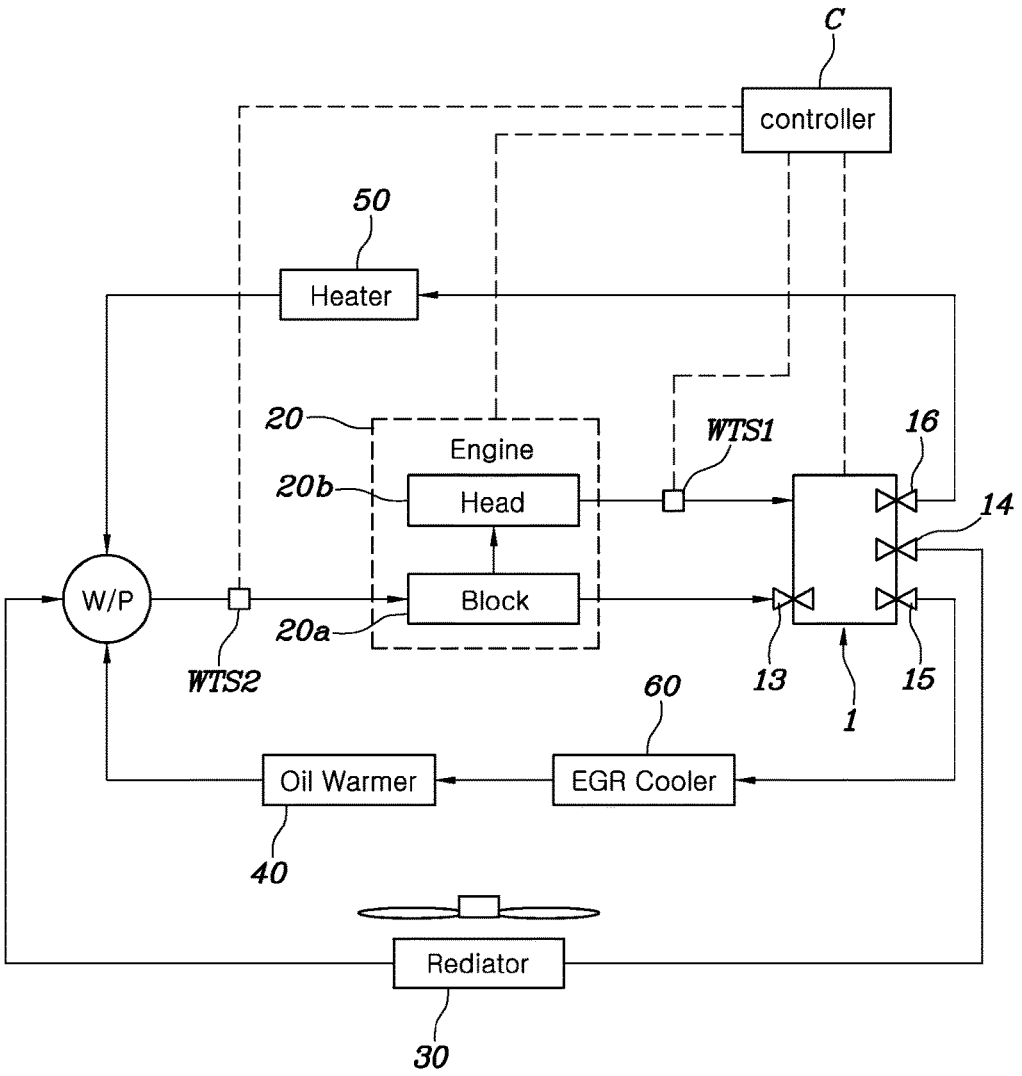
FIG. 1 is a view showing a configuration, in which an EGR cooler is disposed in a flow path with an oil warmer disposed in the flow path in a cooling system for a vehicle according to an embodiment of the present disclosure.

FIG. 1 is a view schematically showing a configuration of a cooling system for a vehicle according to an embodiment of the present disclosure. In this embodiment, an inlet water temperature sensor WTS2 is provided on a flow path at an inlet side of an engine. An outlet water temperature sensor WTS1 is provided on a flow path at an outlet side of the engine.

Further, a flow rate control valve 1 is provided at a rear end of the outlet water temperature sensor WTS1. The flow rate control valve 1 can perform 4-port control, in which four ports can be variably controlled simultaneously by operating a valve body alone provided in the valve.

For example, at least three discharge ports are provided in the flow rate control valve 1. Each of the discharge ports is connected to an oil heat exchanger such as a radiator 30, an oil warmer 40, and the like, and to a flow path with a heater core 50 disposed thereon, respectively, thereby controlling the flow rate of the cooling water discharged to the flow path.

In particular, in flow paths between the flow rate control valve 1 and a water pump, an EGR cooler 60 may be disposed on the flow path on which the oil warmer 40 is disposed. Though not shown in the drawings, in some cases, the EGR cooler 60 may be disposed in the flow path where a heater core 50 is disposed.

Further, a cooling water outlet of a cylinder block 20*a* of the engine 20 and a cooling water outlet of a cylinder head 20*b* communicate independently with the flow rate control valve 1. Further, a block port 13 is provided at a portion of the flow rate control valve 1. The block port 13 communicates with the cooling water outlet of the cylinder block 20*a*, whereby it is possible to control the flow rate of the cooling water introduced in the flow rate control valve 1.

Figure 4:
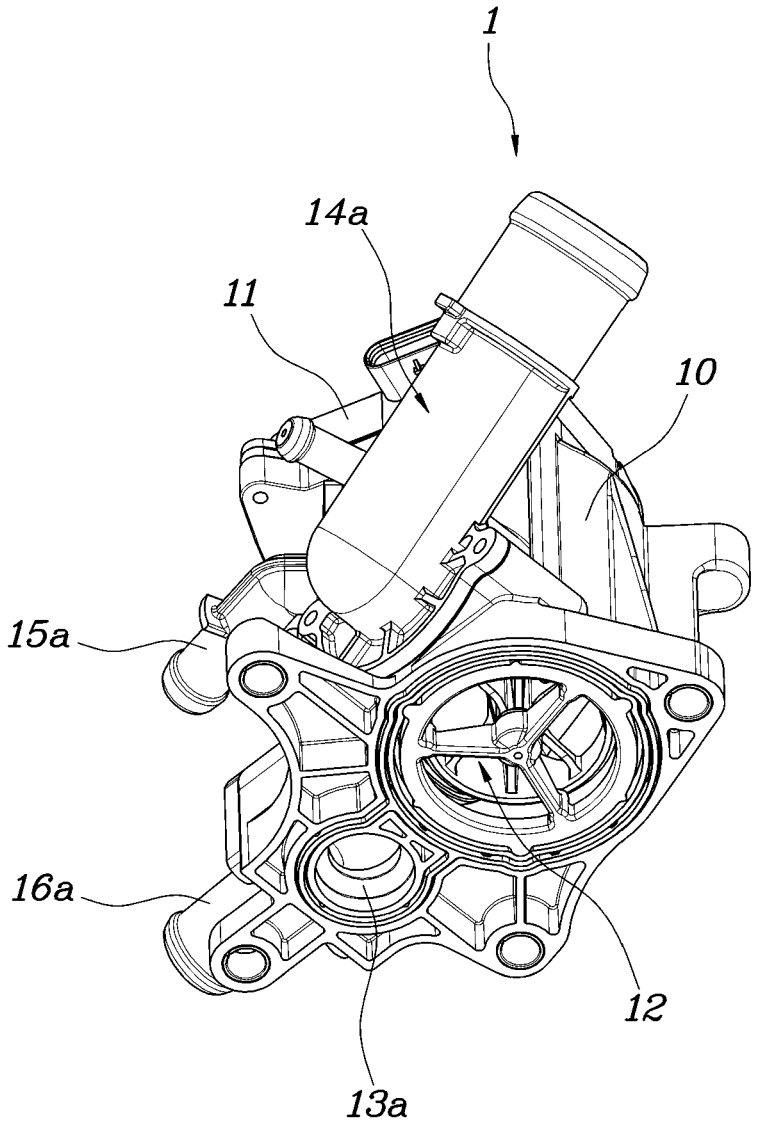
FIG. 4 is a perspective view showing a flow rate control valve applicable to the embodiment of the present disclosure.
Figure 5:
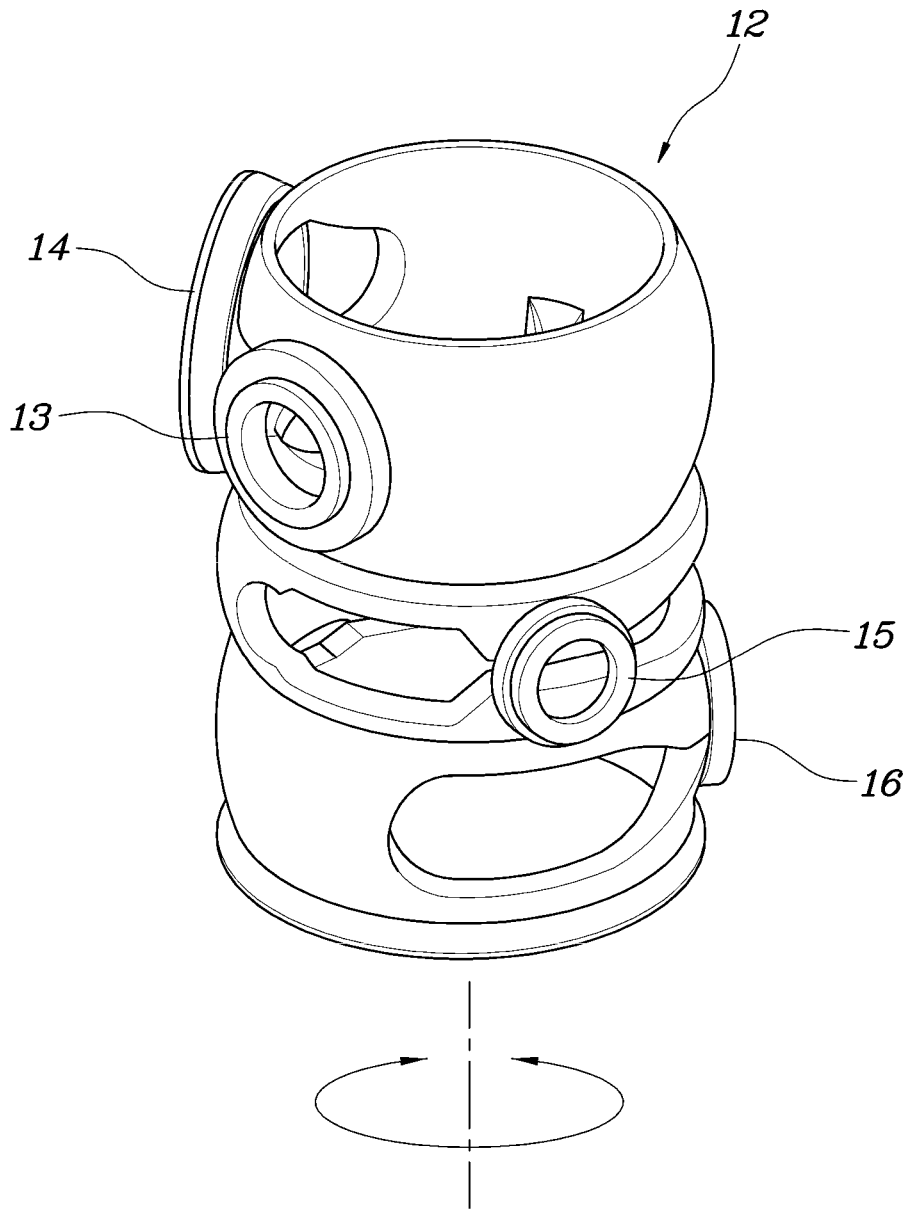
FIG. 5 is a view showing a shape of a valve body provided in the flow rate control valve of FIG. 4, and showing a port arrangement.
Figure 9:
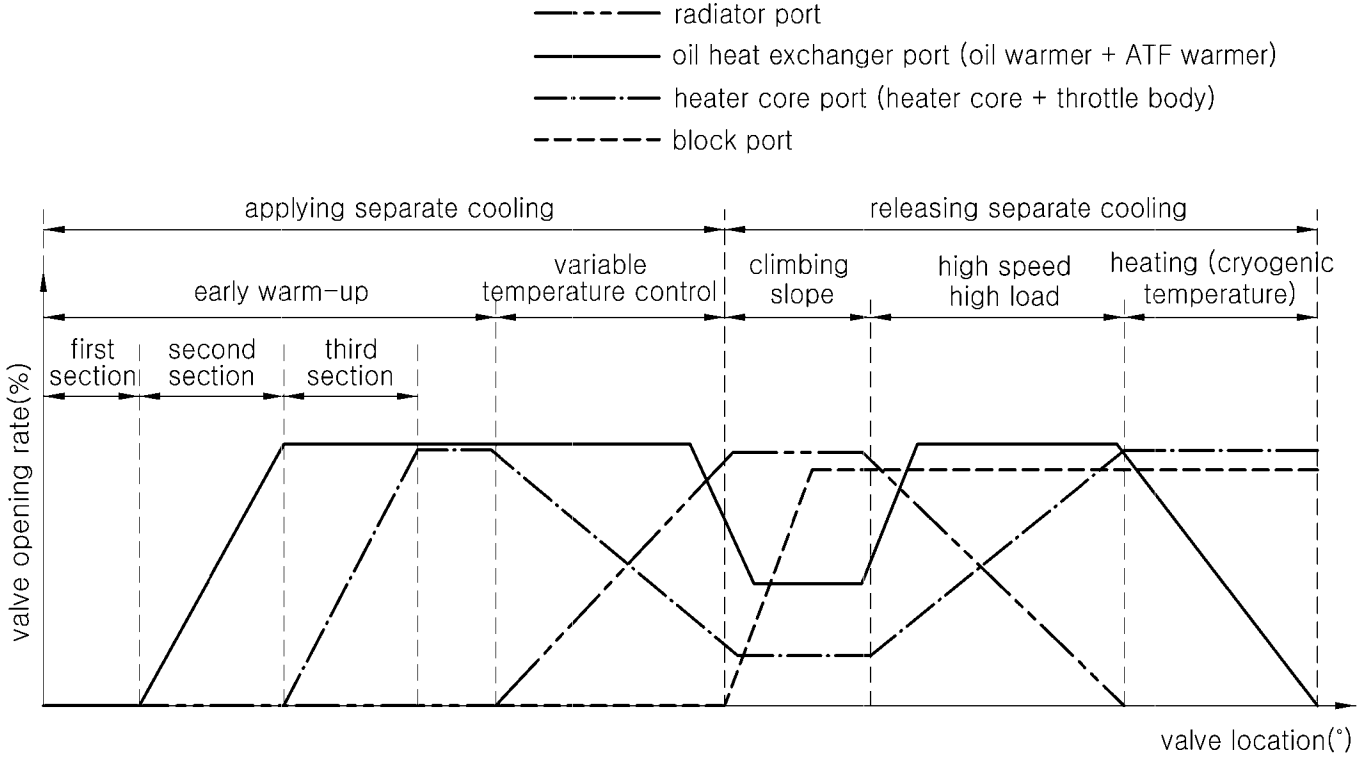

In addition, FIGS. 4 and 5 are views showing the flow rate control valve 1 applicable to an embodiment of the present disclosure. In this embodiment, the flow rate control valve 1 may include a valve housing 10, a driving unit 11, and a valve body 12.

Referring to the drawings, the valve housing 10 may include the block port 13 into which the cooling water discharged from the engine 20 is introduced and through which the introduced cooling water is discharged. The valve housing may also include a radiator port 14, an oil heat exchanger port 15, and a heater core port 16.

For example, the block port 13 may communicate with the cooling water outlet of the cylinder block 20*a*. The radiator port 14 may communicate with the flow path with the radiator 30 disposed thereon. The oil heat exchanger port 15 may communicate with the flow path with the oil warmer 40 disposed thereon. The heater core port 16 may communicate with the flow path with the heater core 50 disposed thereon.

For reference, reference numeral 13*a* shown in FIG. 4 denotes a pipeline communicating with the block port 13. Reference numeral 14*a* denotes a pipeline communicating with the radiator port 14. Reference numeral 15*a* denotes a pipeline communicating with the oil heat exchanger port 15. Reference numeral 16*a* denotes a pipeline communicating with the heater core port 16.

The driving unit 11 is disposed at an upper portion of the valve housing 10 to provide torque. In one example, the drive unit 11 is a motor.

The valve body 12 is provided in the valve housing 10. The valve body 12 is rotationally operated within a predetermined angle range by receiving the torque from the driving unit 11.

The valve body 12 is in a hollow cylindrical shape. The valve body 12 can selectively communicate with the block port 13, the radiator port 14, and the oil heat exchanger port 15 as the rotation angle of the valve body 12 changes.

In other words, the opening degree of each port is controlled as the valve body 12 is rotated, whereby the flow rate of the cooling water can be controlled.

However, the lower portion of the valve body 12 is formed to be open and communicates with the outlet of the cylinder head 20*b*, whereby the cooling water discharged from the cylinder head 20*b* may be always introduced into the valve body 12.

In one embodiment, FIG. 6 is a diagram showing an opening rate of each port as the operating angle of the flow rate control valve 1 changes. In this embodiment, the X-axis of the diagram represents an entire rotation angle (a section between the left end and the right end) of the valve body, and Y-axis represents the opening rate of each port.

In other words, the entire rotation angle of the flow rate control valve 1 may be determined within a predetermined angle range. The operating angle changes within the entire rotation angle according to the driving condition of the vehicle. The opening degrees of the radiator port 14, the oil heat exchanger port 15, the heater core port 16, and the block port 13 change according to the changing angle.

Further, as the block port 13 is opened or closed by the operation of the flow rate control valve 1, it is possible to achieve separate cooling of the cylinder head 20*b* and the cylinder block 20*a* is performed. Further, opening degrees of the radiator port 14, the oil heat exchanger port 15, and the heater core port 16 are controlled, whereby 4-port control can be performed, in which four ports can be variably controlled simultaneously by operating the flow rate control valve 1.

Referring to FIG. 1 and FIG. 6, more specifics of the cooling system for a vehicle according to an embodiment of the present disclosure are illustrated. In a predetermined first section starting from a first end toward a second end of an entire rotational operation section of the flow rate control valve 1, all of the block port 13, the radiator port 14, the oil heat exchanger port 15, and the heater core port 16 may be closed.

In other words, the first section may be the first section located at the left end of FIG. 6. For example, when the engine 20 is cold-started, all ports are closed such that the cooling water is controlled to be stagnant inside the engine 20. This helps to eliminate the loss of heat energy to the outside and to realize quick warm-up of the entire engine. Thus, it is possible to improve fuel efficiency and emissions.

In addition, in a predetermined second section starting from the first section toward the second end of the entire rotational operation section, only the oil heat exchanger port 15 may be opened.

In other words, the second section may be a section bounded by the first section. For example, at a boundary between the first section and the second section, an opening rate of the oil heat exchanger port 15 may exceed 0% such that the oil heat exchanger port starts to be opened.

In one example, the opening rate of the oil heat exchanger port 15 in the second section increases linearly in accordance with changes in the rotational operating angle of the flow rate control valve 1.

Further, in a predetermined third section starting from the second section toward the second end of the entire rotational operation section, the heater core port 16 may be opened with the oil heat exchanger port 15 maximally opened.

In other words, the third section may be a section bounded by the second section. For example, at a boundary between the second section and the third section, the opening rate of the oil heat exchanger port 15 may be 100% such that the oil heat exchanger port is fully opened.

In this embodiment, the opening rate of the oil heat exchanger port 15 in the third section may be maintained at 100% to maintain the fully opened state.

Further, at a boundary between the second section and the third section, the opening rate of the heater core port 16 may exceed 0% such that the heater core port starts to be opened. In one example, the opening rate of the heater core port 16 in the third section increases linearly in accordance with changes in the rotational operating angle of the flow rate control valve 1.

In this embodiment, in the third section, the opening rate of the heater core port 16 may be 100% such that the heater core port is fully opened, or may increase up to a predetermined opening rate less than 100% such that the heater core port is partially opened.

In other words, the first section is a section where the flow of the cooling water is stopped. The first section is followed by the second section, where the oil heat exchanger port 15 is opened. After the oil heat exchanger port 15 is fully opened, the third section follows, where the heater core port 16 is opened.

Accordingly, the cooling water with the increased temperature through the flow stagnation control is first supplied to the oil heat exchanger side. The heat energy generated from the engine is used to rapidly raise the cooling water temperature and the oil temperature, which is advantageous for improving fuel efficiency.

Meanwhile, a control method for a cooling system provided with the above described flow rate control valve 1 may include stopping the flow, determining the cooling water temperature, and opening the oil heat exchanger port.

Figure 2:
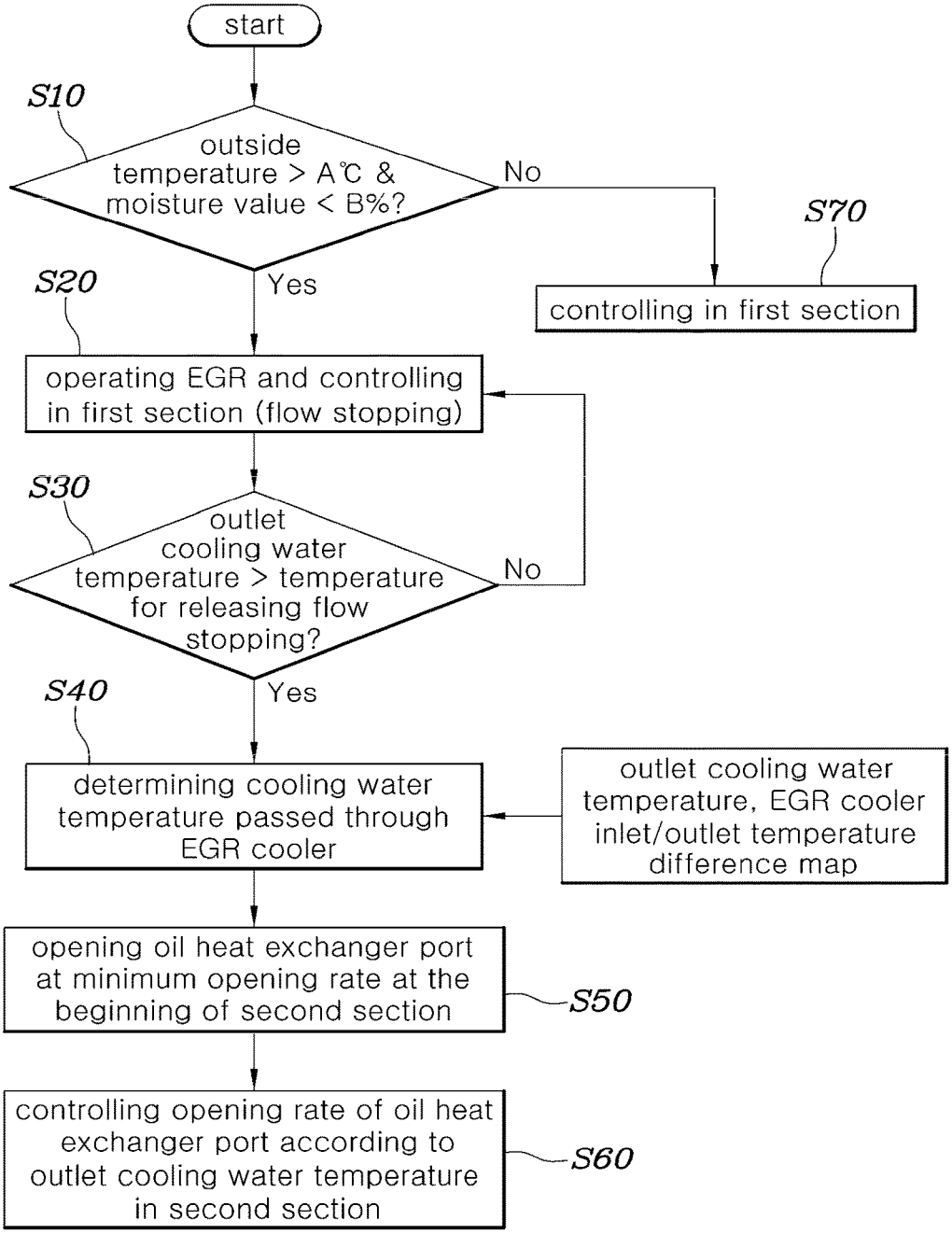
FIGS. 2 and 3 are views showing the control flow of the cooling system for a vehicle according to the embodiment of the present disclosure.

Referring to FIGS. 1, 2, and 6, in the step of stopping the flow, when an outside temperature exceeds a preset temperature on start of the vehicle, the flow of the cooling water may be stopped by closing ports of the flow rate control valve 1 valve while a controller C controls EGR to be operated.

In other words, the flow rate control valve 1 is operated within the first section, such that all ports of the flow rate control valve 1 are closed, thereby stopping the flow of the cooling water.

In addition, in the step of stopping the flow, when a humidity sensor is provided, a moisture value may be determined along with the outside temperature.

Further, in the step of determining cooling water temperature, when an outlet cooling water temperature measured by the outlet water temperature sensor WTS1 exceeds a preset temperature for releasing the stopping of the flow, the controller C may determine a cooling water temperature passed through the EGR cooler 60 in relation to the outlet cooling water temperature and EGR cooler inlet/outlet temperature difference map data of a cooling water flow rate flowing through the EGR cooler 60.

Further, in the step of opening the oil heat exchanger port, the oil heat exchanger port 15, at which the EGR cooler 60 is disposed, may be opened to prevent the cooling water temperature passed through the EGR cooler 60 from exceeding a boiling cooling water temperature set to prevent overheating of the EGR cooler.

In this embodiment, in an initial section of the step of opening the oil heat exchanger port, to finely control the cooling water flow rate supplied to the EGR cooler 60, the flow rate control valve 1 may be controlled such that the oil heat exchanger port 15 is opened at a minimum opening rate for a predetermined time.

Further, after the initial section of the step of opening the oil heat exchanger port, the opening rate of the oil heat exchanger port 15 may be determined according to the outlet cooling water temperature to control the flow rate control valve 1.

In other words, at the beginning of engine starting, based on the outside temperature and the initial cooling water temperature, a heating priority mode, in which heating is performed, and a fuel economy priority mode, in which fuel economy is considered to be the priority, may be determined. When each of the outside temperature and the initial cooling water temperature is more than a predetermined temperature, the fuel economy priority mode is performed to operate EGR.

More specifically, in order to use EGR, it is required that the outside temperature is over a predetermined temperature, and when a humidity sensor is provided, it is also required that the moisture value is below a predetermined humidity (step S10 in FIG. 2).

On the contrary, if the outside temperature is below a predetermined temperature, or the moisture value is over a predetermined humidity, condensate is generated in the intake manifold. When condensate is generated in the EGR cooler 60, cooler tubes or pins may corrode, which may cause damage to the engine, so the flow rate control valve 1 is controlled to perform only the flow stopping control without using the EGR (step S70 in FIG. 2).

As described above, when the outside temperature is over a predetermined temperature, the flow rate control valve 1 is operated within the first section to maintain the flow stopping of the engine (step S20 in FIG. 2), and it is judged whether the outlet cooling water temperature measured at an outlet side of the engine reaches a predetermined temperature (a flow stagnation-off reference temperature) (step S30 in FIG. 2). If the predetermined temperature reaches, using engine speed, engine torque, the flow rate of the cooling water passing through the EGR cooler 60, the inlet/outlet temperature difference data of the EGR cooler 60, and the outlet cooling water temperature, the cooling water temperature passing through the EGR cooler is determined (step S40 in FIG. 2).

Further, the flow rate control valve 1 is operated to enter the second section, such that the cooling water is supplied to the EGR cooler 60 (step S50 in FIG. 2). Here, the flow rate of the cooling water supplied to the EGR cooler 60 is finely controlled by calculating the opening degree of the oil heat exchanger port 15 where the cooling water temperature can be heated as quickly as possible while the cooling water temperature determined in step S40 does not exceed a preset boiling temperature.

In this embodiment, in the cooling system according to the embodiment of the present disclosure, since the EGR cooler 60 is disposed at the rear end of the flow rate control valve 1, the outlet cooling water temperature measured in the outlet water temperature sensor WTS1 disposed at the engine outlet represents the cooling water temperature supplied to the EGR cooler 60. The outlet cooling water temperature may be used to control the flow rate of the cooling water supplied to the EGR cooler 60.

For example, under the condition that the EGR cooler 60 is 100% opened, when the inlet/outlet temperature difference of the EGR cooler 60 is 6° C. and the outlet cooling water temperature at the engine outlet (a temperature for releasing flow stopping) is 70° C., if the cooling water flow rate passing through the EGR cooler 60 is 25% as compared to the fully opened EGR cooler 60, the inlet/outlet temperature difference of the EGR cooler 60 is 24° C. The cooling water temperature at the outlet of the EGR cooler 60 can be calculated at 94° C. (70° C.+24° C.).

In this manner, within the range where the cooling water temperature does not exceed a preset boiling temperature, the flow rate of the cooling water supplied to the EGR cooler 60 is controlled by adjusting the opening degree of the oil heat exchanger port 15.

Further, in step S50, to allow the cooling water warmed up at the engine outlet to be introduced into the EGR cooler 60, the oil heat exchanger port 15 is opened at a preset minimum opening rate for about 1 to 2 seconds. Further, in addition to the minimum opening rate, the warming up is performed by increasing the opening rate of the oil heat exchanger port 15 gradually according to the outlet cooling water temperature (step S60).

In addition, the step of opening in the present disclosure may include determining an opening rate compensation value, and compensating control.

Figure 3:
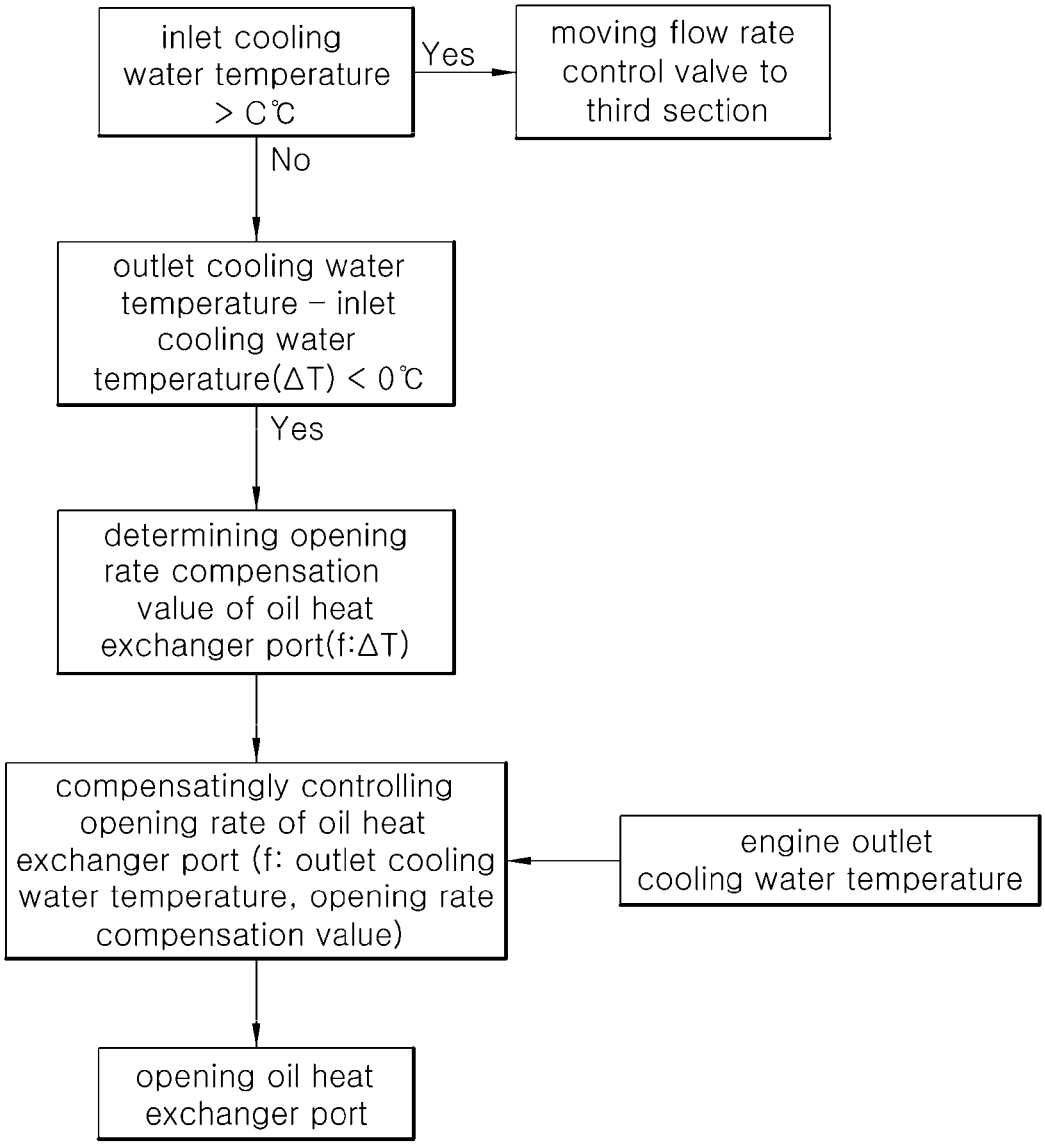

Referring to FIG. 3, in the step of determining an opening rate compensation value, when the inlet cooling water temperature measured by the inlet water temperature sensor WTS2 after the initial section of the opening control is equal to or lower than a predetermined temperature, and higher than the outlet cooling water temperature measured by the outlet water temperature sensor WTS1, the opening rate compensation value of the oil heat exchanger port 15 may be determined. The opening rate compensation value may be based on a function of a difference value between the inlet cooling water temperature and the outlet cooling water temperature.

Further, in the step of compensating control, the oil heat exchanger port 15 may be controlled to be opened by compensatingly feeding the opening rate compensation value of the outlet cooling water temperature back to the opening rate of the oil heat exchanger port 15.

In other words, in the second section, when controlling the opening degree of the oil heat exchanger port 15, if the inlet cooling water temperature passed through the EGR cooler 60 and measured by the inlet water temperature sensor WTS2 is over the outlet cooling water temperature, it is judged that the oil heat exchanger port 15 is slightly opened due to unknown reasons. In this case, by using the inlet cooling water temperature, the opening degree of the oil heat exchanger port 15 is compensated. Based on the compensated opening rate, the opening degree of the oil heat exchanger port 15 is increased by feedback compensation, whereby the flow rate of the cooling water at the side of the EGR cooler 60 is increased.

As described above, the present disclosure is configured such that the flow rate of the cooling water supplied to the EGR cooler 60 is controlled according to the outlet temperature of the engine. Feedback compensation of the cooling water flow rate supplied to the EGR cooler 60 is performed based on the inlet temperature of the engine, simultaneously, whereby the cooling water flow rate supplied to the EGR cooler 60 is optimized.

According to the embodiment of the present disclosure, since the cooling water with the increased temperature through the flow stagnation control is first supplied to the oil heat exchanger side, the heat energy generated from the engine is used to rapidly raise the cooling water temperature and the oil temperature. Further, the warm-up characteristic is improved through the exhaust heat recovery function by heat exchange between the exhaust gas and the cooling water in the EGR cooler 60, whereby it is possible to improve fuel efficiency by reducing friction and heat loss.

Although an embodiment of the present disclosure has been described for illustrative purposes, those having ordinary skill in the art will appreciate that various modifications, additions and substitutions are possible, without departing from the scope and spirit of the disclosure as disclosed in the accompanying claims.

What is claimed is:

1. A cooling system for a vehicle, the cooling system comprising:

a block port communicating with a cooling water outlet of a cylinder block of an engine;

a radiator port communicating with a radiator;

an oil heat exchanger port communicating with an oil heat exchanger and an EGR cooler; and a flow rate control valve provided with a heater core port communicating with a heater core, wherein in a predetermined first section starting from a first end toward a second end of an entire rotational operation section of the flow rate control valve, the block port, the radiator port, the oil heat exchanger port, and the heater core port are closed;

in a predetermined second section starting from the first section toward the second end of the entire rotational operation section, the oil heat exchanger port is opened; and in a predetermined third section starting from the second section toward the second end of the entire rotational operation section, the heater core port is opened with the oil heat exchanger port maximally opened.

2. The cooling system of claim 1, wherein at a boundary between the first section and the second section, an opening rate of the oil heat exchanger port exceeds 0% such that the oil heat exchanger port starts to be opened; and at a boundary between the second section and the third section, the opening rate of the oil heat exchanger port is 100% such that the oil heat exchanger port is fully opened.

3. The cooling system of claim 2, wherein at a boundary between the second section and the third section, an opening rate of the heater core port exceeds 0% such that the heater core port starts to be opened.

4. The cooling system of claim 3, wherein the opening rate of the oil heat exchanger port in the second section and the opening rate of the heater core port in the third section increase linearly in accordance with the rotational operation of the flow rate control valve.

5. A control method for a cooling system for a vehicle, in which the cooling system includes a block port communicating with a cooling water outlet of a cylinder block of an engine, a radiator port communicating with a radiator, an oil heat exchanger port communicating with an oil heat exchanger and an EGR cooler, and a flow rate control valve provided with a heater core port communicating with a heater core, with an inlet water temperature sensor and an outlet water temperature sensor respectively disposed at an inlet side and an outlet side of the engine, and with the flow rate control valve disposed at a rear end of the outlet water temperature sensor, the control method comprising:

when an outside temperature exceeds a preset temperature on start of the vehicle, stopping a flow of cooling water by closing ports of the flow rate control valve while a controller controls EGR to be operated;

when an outlet cooling water temperature measured by the outlet water temperature sensor exceeds a preset temperature for releasing the stopping the flow, determining a cooling water temperature passed through the EGR cooler by the controller in relation to the outlet cooling water temperature and EGR cooler inlet/outlet temperature difference map data of a cooling water flow rate flowing through the EGR cooler; and opening the oil heat exchanger port at which the EGR cooler is disposed to prevent the cooling water temperature passed through the EGR cooler from exceeding a boiling cooling water temperature set to prevent overheating of the EGR cooler.

6. The control method of claim 5, wherein in the stopping the flow, a moisture value is determined.

7. The control method of claim 5, wherein in an initial section of the opening the oil heat exchanger port, to finely control the cooling water flow rate supplied to the EGR cooler, the flow rate control valve is controlled such that the oil heat exchanger port is opened at a minimum opening rate for a predetermined time.

8. The control method of claim 7, wherein after the initial section of the opening the oil heat exchanger port, the opening rate of the oil heat exchanger port is determined according to the outlet cooling water temperature to control the flow rate control valve.

9. The control method of claim 7, wherein the opening the oil heat exchanger port includes:

when an inlet cooling water temperature measured after the initial section by the inlet water temperature sensor is equal to or lower than a predetermined temperature, and higher than the outlet cooling water temperature measured by the outlet water temperature sensor, determining an opening rate compensation value of the oil heat exchanger port based on a function of a difference value between the inlet cooling water temperature and the outlet cooling water temperature; and compensatingly controlling the oil heat exchanger port to be opened by compensatingly feeding the opening rate compensation value of the outlet cooling water temperature back to the opening rate of the oil heat exchanger port.

* * * * *